US006292970B1

(12) United States Patent
Rief et al.

(10) Patent No.: US 6,292,970 B1
(45) Date of Patent: Sep. 25, 2001

(54) TURBINE-DRIVEN AUTOMATIC SWIMMING POOL CLEANERS

(75) Inventors: Dieter J. Rief; Manuela Rief; Rosemarie Rief, all of Santa Rosa, CA (US)

(73) Assignee: Poolvergnuegen, Santa Rosa, CA (US)

( * ) Notice: Subject to any disclaimer, the term of this patent is extended or adjusted under 35 U.S.C. 154(b) by 0 days.

(21) Appl. No.: 09/575,993

(22) Filed: May 23, 2000

Related U.S. Application Data

(60) Provisional application No. 60/158,884, filed on Oct. 12, 1999.

(51) Int. Cl.[7] ..... A47L 9/00; E04H 4/16

(52) U.S. Cl. ..... 15/1.7; 15/387; 415/141; 418/266

(58) Field of Search ..... 15/1.7, 29, 415.1, 15/387; 415/141, 140; 418/266, 268, 148

(56) References Cited

U.S. PATENT DOCUMENTS

| | | | | |
|---|---|---|---|---|
| 2,806,236 | * | 9/1957 | Stefano | 418/266 |
| 3,321,787 | * | 5/1967 | Myers | 15/1.7 |
| 3,391,678 | * | 7/1968 | Luckhardt | 418/266 |
| 3,626,265 | * | 12/1971 | Kraakman | 418/266 |
| 3,803,658 | * | 4/1974 | Raubenheimer | 15/1.7 |
| 3,959,838 | * | 6/1976 | Hannah | 15/1.7 |
| 4,449,265 | * | 5/1984 | Hoy | 15/387 |
| 4,509,221 | * | 4/1985 | Simpson | 15/29 |
| 5,197,158 | * | 3/1993 | Moini | 15/1.7 |

FOREIGN PATENT DOCUMENTS

| | | | | |
|---|---|---|---|---|
| 2612043 | * | 9/1977 | (DE) | 15/1.7 |

* cited by examiner

*Primary Examiner*—Gary K. Graham
(74) *Attorney, Agent, or Firm*—Jansson, Shupe & Munger, Ltd.

(57) ABSTRACT

An automatic pool cleaner having a turbine including a housing having a flow chamber and chamber wall with inlet and outlet ports, a rotatably-mounted turbine rotor, and turbine vanes each having a proximal end connected to the rotor and a distal end movable with respect to the rotor between extended positions adjacent to the wall and retracted positions spaced from the wall and closer to the rotor to allow passage of debris pieces of substantial size through the turbine. Some preferred embodiments are: curved vanes; vanes pivotably mounted to the rotor; and an eccentric rotor mount within the turbine chamber. Pivotably-mounted vanes preferably have enlargements at their proximal ends which are freely insertable into cavities in the rotor; most preferably, each vane is symmetrical about a center line such that either end is able to serve as the proximal end in engagement with the rotor.

23 Claims, 5 Drawing Sheets

TURBINE-DRIVEN AUTOMATIC SWIMMING POOL CLEANERS

RELATED APPLICATION

This is a regular patent application based on and claiming the benefit of the filing date of U.S. Provisional Patent Application Ser. No. 60/158,884, filed on Oct. 12, 1999 by applicants herein.

FIELD OF THE INVENTION

The present invention relates to swimming pool cleaners and, more particularly, to automatic pool cleaners driven by the flow of water therethrough. Still more particularly, the invention relates to automatic pool cleaners of the type having turbines for the purpose of providing pool cleaner movement along the underwater surfaces of a pool.

BACKGROUND OF THE INVENTION

Automatic swimming pool cleaners of the type that move about the underwater surfaces of a swimming pool are driven by many different kinds of systems. A variety of different pool cleaner drive devices in one way or another harness the flow of water, as it is drawn through (or in some cases pushed through) the pool cleaner (by the pumping action of a remote pump) for debris collection purposes, to create forward pool cleaner movement. One kind of system often used for this purpose is turbines, which translate water movement into the turning of drive wheels.

Various turbine-driven automatic pool cleaners have been made and used, or at least disclosed in the prior art. However, turbine-driven automatic pool cleaners of the prior art have a number of problems and shortcomings. This invention is directed toward overcoming such problems and shortcomings, and to providing a substantially improved turbine-driven automatic pool cleaner.

The turbines of automatic pool cleaners involve securing locomotion power from debris-laden water, because pool cleaners by nature are involved with seeking to remove debris from the water. Indeed, large pieces of debris are occasionally sucked into the turbine chamber and of a pool cleaner turbine, and this obstructs the operation of the device. Because of this problem, turbine-driven automatic pool cleaners typically sought to accommodate the debris by providing some spacing between the tips (distal ends) of turbine vanes and the walls of turbine chambers. This approach is problematic because it involves a loss of power, in a situation in which the amount of hydraulic power provided (by a remote pump) is often already limited.

While some improvements have been made in recent years in turbine-driven automatic pool cleaners of various kinds, adequate solutions to the on-going conflict between the twin concerns of loss of power and risk of clogging have not been forthcoming, particularly in situations in which debris-laden water flows through the turbine. Furthermore, there has been a need for an improved turbine-driven automatic pool cleaner, and a particular need for improvements which allow turbine-driven pool cleaners of both the suction type and the pressure type.

OBJECTS OF THE INVENTION

It is a primary object of this invention to provide an improved turbine-driven automatic pool cleaner overcoming problems and shortcomings of the prior art, including those mentioned above.

Another object of this invention is to provide an improved automatic pool cleaner turbine which is able to accommodate substantial pieces of debris as they move through the turbine chamber, doing so without either significant losses of power or significant risks of clogging and malfunction.

Another object is to provide improvements in automatic pool cleaner of the turbine-driven type which are applicable in both vacuum pool cleaners and pressure pool cleaners.

Still another object of the invention is to provide an improved turbine for automatic pool cleaners for which dimensional tolerances and clearances are not of particular concern when it comes to preserving power and operability.

These and other objects of the invention will be apparent from the following descriptions and from the drawings.

SUMMARY OF THE INVENTION

The automatic pool cleaner of this invention is an improvement in the type of pool cleaner which is motivated by the flow of water through it (caused by a pool-adjacent pump) to move along a pool surface to be cleaned. More specifically, the pool cleaner of this invention is of the type which include a turbine. The improved pool cleaner of this invention overcomes certain problems and shortcomings of devices of the prior art, and provides important advantages.

The improved pool cleaner of this invention includes: a turbine housing having a water-flow chamber formed by a chamber wall, the water-flow chamber having inlet and outlet ports; a turbine rotor rotatably mounted in the housing; and at least one, and most preferably several, turbine vanes each having a proximal end connected to the rotor and a distal end movable with respect to the rotor between extended positions adjacent to the wall and retracted positions spaced from the wall and closer to the rotor in order to facilitate passage of debris pieces of substantial size through the turbine.

Most preferably, the distal edges of the vanes contact the chamber wall in their extended positions. This provides high efficiency in the usage of energy provided by the pump by means of the water flow. Thus, pool cleaners in accordance with this invention can operate acceptably even with pumps which provide pressures low enough to have been problematic for operation of automatic pool cleaners of the prior art. The pool cleaner of this invention is able to draw water with substantial pieces of debris in it through the turbine without clogging, by virtue of the retraction of the vanes such that their distal ends provide space for debris flow. Thus, the turbine allows good engagement of the vanes with the chamber walls whenever possible, while allowing adjustment to accommodate debris flow.

In certain highly preferred embodiments of this invention, the inlet port is substantially adjacent to the pool surface, while the outlet port is aligned above the inlet port such that water and debris can flow through the turbine in a substantially straight line which is tangential to the rotor.

This invention can be in the form of an automatic pool cleaner which is a vacuum cleaner or in the form which is a pressure cleaner, depending on arrangements of the inlet and outlet ports and the manner in which water flow is directed. If used as a pressure cleaner, one or more venturi nozzles may be used to draw water and debris from the underwater surfaces to be cleaned. Details of one vacuum cleaner and one pressure cleaner in accordance with this invention are set forth in co-pending and commonly-owned patent documents filed under the Patent Cooperation Treaty on or about May 25, 2000, namely: PCT Application No. PCT/US00/14771, entitled "Four-Wheel-Drive Automatic Swimming Pool Cleaner," the inventors of which are Dieter J. Rief and Manuela Rief; and PCT Application No. PCT/

US00/14770, entitled "Swimming Pool Pressure Cleaner with Internal Steering Mechanism," the inventors of which are Dieter J. Rief and Manuela Rief.

In the automatic pool cleaner of the present invention, the turbine chamber is preferably substantially round in cross-sections normal (perpendicular) to the axis of the rotor, although other shapes are possible. In one preferred embodiment of this type, rather than having a rotor which is concentric with the chamber, the rotor is slightly offset to one side. More specifically, the turbine chamber has a first side where the water and debris flow from the inlet port to the outlet port and an opposite side which returns back to the first side, and the rotor has an axis of rotation offset toward the opposite side such that the chamber wall is closer to the rotor at the opposite side than it is at the first side. The vanes, particularly when they are rotatably mounted to the rotor (see below), tend to be extended as they move through the first side of the chamber, but tend to collapse as they move through the opposite side of the chamber.

This offset arrangement makes the flow cross-section reduced on the opposite side, which minimizes any tendency for flow of water in the wrong direction and encourages the flow of water and debris from the inlet port to the outlet port along the first side of the chamber as intended. Due to collapsing of turbine vanes on the opposite side of the chamber (i.e., their retraction away from the chamber wall), less power is needed to turn the turbine and, correspondingly, there is less restriction. All the water that passes through the vacuum chamber makes contact with a turbine vane, thereby maximizing efficiency.

In highly preferred embodiments of the present invention, the vanes are curved. In particularly preferred embodiments, the vanes are pivotably mounted with respect to the rotor. This facilitates extension and retraction of the vanes, as described above. Most preferably, the vanes are attached to the rotor in a manner such that they pivot with respect to the rotor about axes which are parallel to the axis of the rotor. The vanes are most preferably made of substantially rigid material.

In preferred embodiment, at the distal ends of the vanes are edge enlargements made for sliding engagement with the chamber wall. Preferably, similar edge enlargements are also at the proximal ends of the vanes and facilitate pivotable mounting to the rotor. More specifically, in certain arrangements, the rotor has an exterior surface beneath which, for each vane, is a cavity which pivotably holds the proximal end of the vane, which has an enlargement received into the cavity. For each vane, the cavity in the rotor and the proximal-end enlargement of the vane are sized for free insertion of the enlargement into the cavity, thereby facilitating attachment and pivotable engagement. Preferably, the cavities and proximal-end enlargements of the vanes are substantially cylindrical.

This male-vane-into-female-rotor arrangement is particularly preferred. Variations of such preferred arrangement include male proximal edge enlargements of lesser axially-parallel lengths than the length of the female cavity. However, the design of the pivoting connection should minimize any passage of water therethrough, because this would entail possible loss of power. A wide variety of male-vane-into-female-rotor arrangements are possible.

Most preferably, each of the vanes has enlargements at both its proximal and distal ends (edges) such that the vane is substantially symmetrical about a center line. This allows either end of the vane to be pivotably engaged in a cavity, so that either end can be the proximal end of the vane. The most preferred enlargement shape is substantially cylindrical.

While the male-vane-into-female-rotor arrangement is highly preferred, another possibility is for the vanes to have female cavity-defining proximal ends (edges), with the rotors having male projections with enlarged edges to be received into the cavities in the vanes in a snap-fitting relationship which allows easy pivoting of the vanes. Alternatively, the vanes can be assembled with the rotor by sliding of the vanes over the enlarged proximal edges projecting from the rotor.

In some cases, the vanes may be fabricated from a resilient polymer material, such that their distal ends retract from the chamber wall by the flexing of the material. Such vanes are most preferably integrally formed with the rotor and fabricated to assume a generally extended configuration when not acted on by any force; however, the configuration and dimensioning allows flex to allow debris to pass through the turbine without impeding the radial velocity of the rotor. Pivotable mounting of the vanes is preferred, however, because some energy is lost to friction and to the forces necessary to flex the vanes. The most preferred embodiments are those with hinged vanes.

Still another alternative embodiment involves a plurality of springs secured to the rotor, each spring juxtaposed to one of the vanes to urge the vane into a generally extended position.

As already alluded to above, the turbine of the present invention produces greater output torque and power with the same input energy as prior art turbines commonly used in automatic swimming pool cleaners. This improvement results primarily from the fact that the vanes, which are preferably curved, have their radial positions repetitively actuated by hydraulic forces and the interior surface of the chamber. Thus, the turbine vanes are always oriented in optimum positions as they drive the turbine rotor about its axis; this provides maximum efficiency and power. The pivoting (or flexing) action of the vanes allows maintenance of close spacing between the chamber wall and the distal ends of the vanes, and this minimizes by-pass of water and consequential power losses.

As already described, a particular advantage of this pool cleaner invention is its ability to accommodate and pass debris without jamming. Additionally, the turbine provides effective drive power even under relatively low hydraulic suctions and pressures. Moreover, the device is inexpensive to manufacture and to maintain.

One advantage of this invention, because of the efficiency of operation of this pool cleaner turbine, is that larger inlet openings may be used and this permits greater flows; consequently, more power is derived from the vanes under lower pressure drop requirements.

A variety of adjustment is possible with turbine vanes of the pool cleaner of this invention—to accommodate different flow rates. The manner of hinging, the choice of materials, the dimensions of flexing materials are all among the things that can be adjusted to achieve the desired operation.

The preferred hinging arrangement of vanes is most advantageous in passing and bypassing debris and for extracting maximum power. When passable impediments such as leaves or sticks are encountered in the vacuum chamber of the turbine, the vanes pivot and ride under the impediment so that the rotor motion is not interrupted. Thus, the debris will pass without jamming the turbine or stopping motion. By contrast, in conventional pool cleaner turbines dirt and other impediments can become jammed between chamber wall and turbine vanes, thus bringing the device to a stop or causing loss of effectiveness.

Experimentation in connection with this invention has shown the pool cleaner turbine of this invention to be very powerful, allowing excellent performance even under low suction. The invention allows higher rates of water processing, larger pieces of debris to pass through, and creates less back pressure on the filter and pump system adjacent to the pool. All of which results in more water circulation through a remote filter system during a given period of time.

BRIEF DESCRIPTION OF THE DRAWINGS

FIG. 3*a* is a detailed view of a vane of FIG. 3, showing a vane which pivots about a rigid molded spring.

FIG. 3*b* is a detailed view of a vane of FIG. 3, showing a vane which pivots about a metal or plastic spring.

FIG. 3*c* is a detailed view of a vane of FIG. 3, showing a flexible elastic vane.

FIG. 3*d* is a detailed view of a flexible elastic vane integrally formed with the turbine rotor.

FIG. 4 includes more pool cleaner structure than is shown in FIGS. 1–3*d*.

DETAILED DESCRIPTION OF PREFERRED EMBODIMENTS

Figure 1:
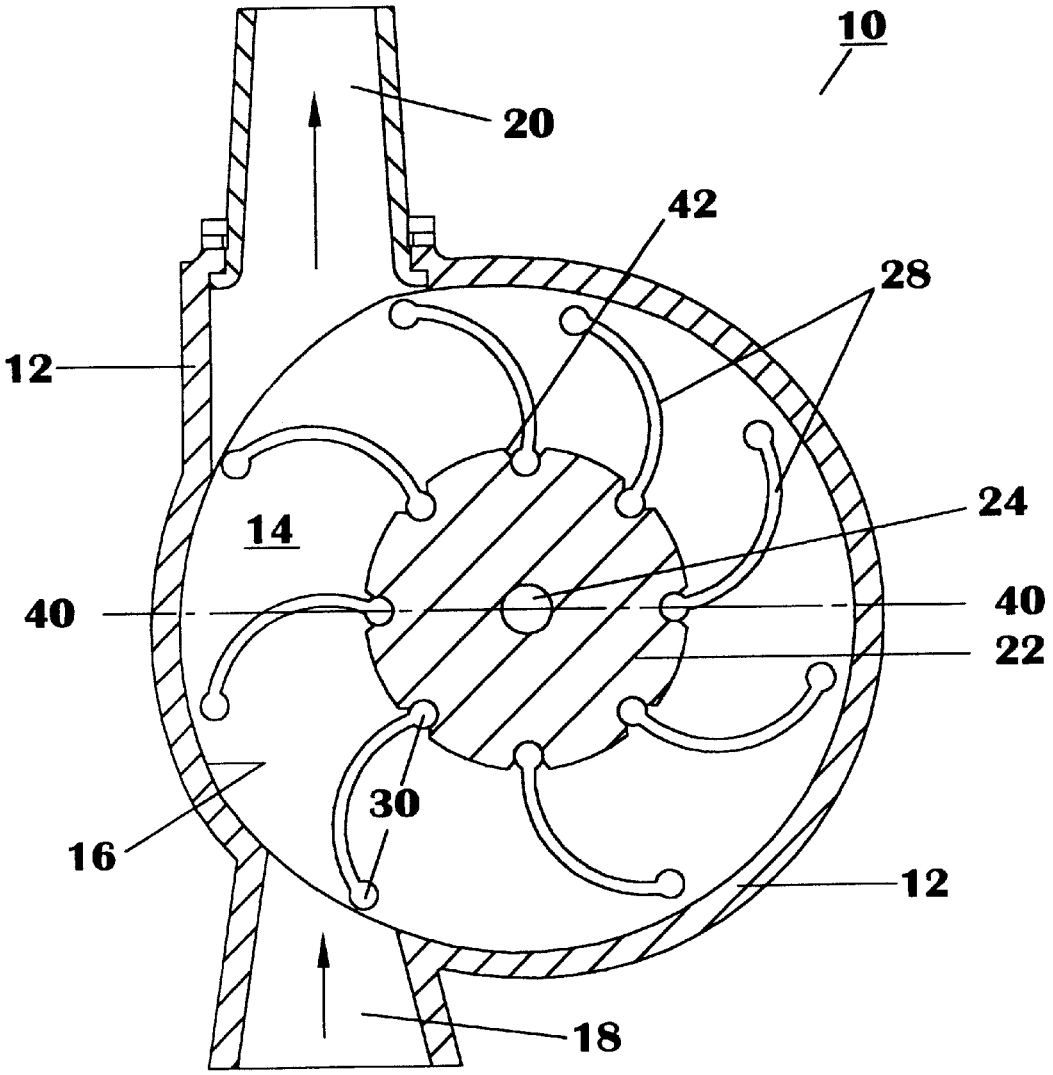
FIG. 1 is a cross-sectional side elevation view of the turbine portion of a preferred automatic pool cleaner in accordance with this invention, the turbine being shown in the orientation it would have in the pool cleaner as it sits on a horizontal pool surface. The pool cleaner of FIG. 1 is of the suction type.
Figure 2:
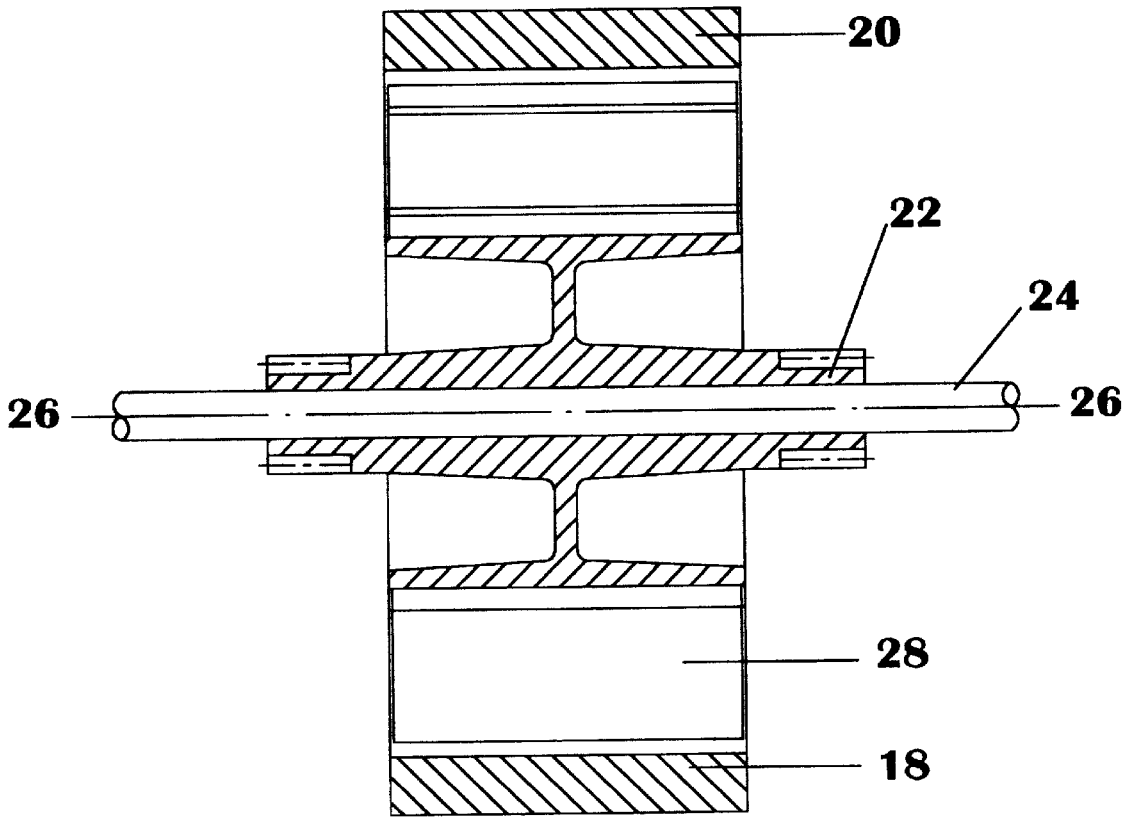
FIG. 2 is front cross-sectional view of the apparatus of FIG. 1 taken along section 40—40 as indicated in FIG. 1.

FIG. 1 illustrates a pool cleaner turbine 10 which includes a turbine housing 12 having an interior vacuum chamber 14, an interior chamber wall 16, a suction inlet port 18, and a suction outlet port 20. A turbine rotor 22 is mounted on shaft 24 which is rotatably mounted in turbine housing 12 so as to rotate about the axis 26 (see FIG. 2) of shaft 24. Chamber wall 16 is substantially round in cross-sections which are normal to axis 26, but can be of virtually any shape, oval, eccentric or otherwise.

As shown in FIG. 1, rotor 22 rotates in a clockwise direction. To the left of rotor 22, where numeral 14 is placed, is a first side of chamber 14. This is where water and debris flow from inlet port 18 to outlet port 20 in a generally straight upward direction. Chamber 14 also includes an opposite side, which is to the right of rotor 22. Axis 26 of rotor 22 is more closely spaced with respect to chamber wall 16 at such opposite side than it is in the first side. This eccentric mount is beneficial, as set forth above.

Figure 3:
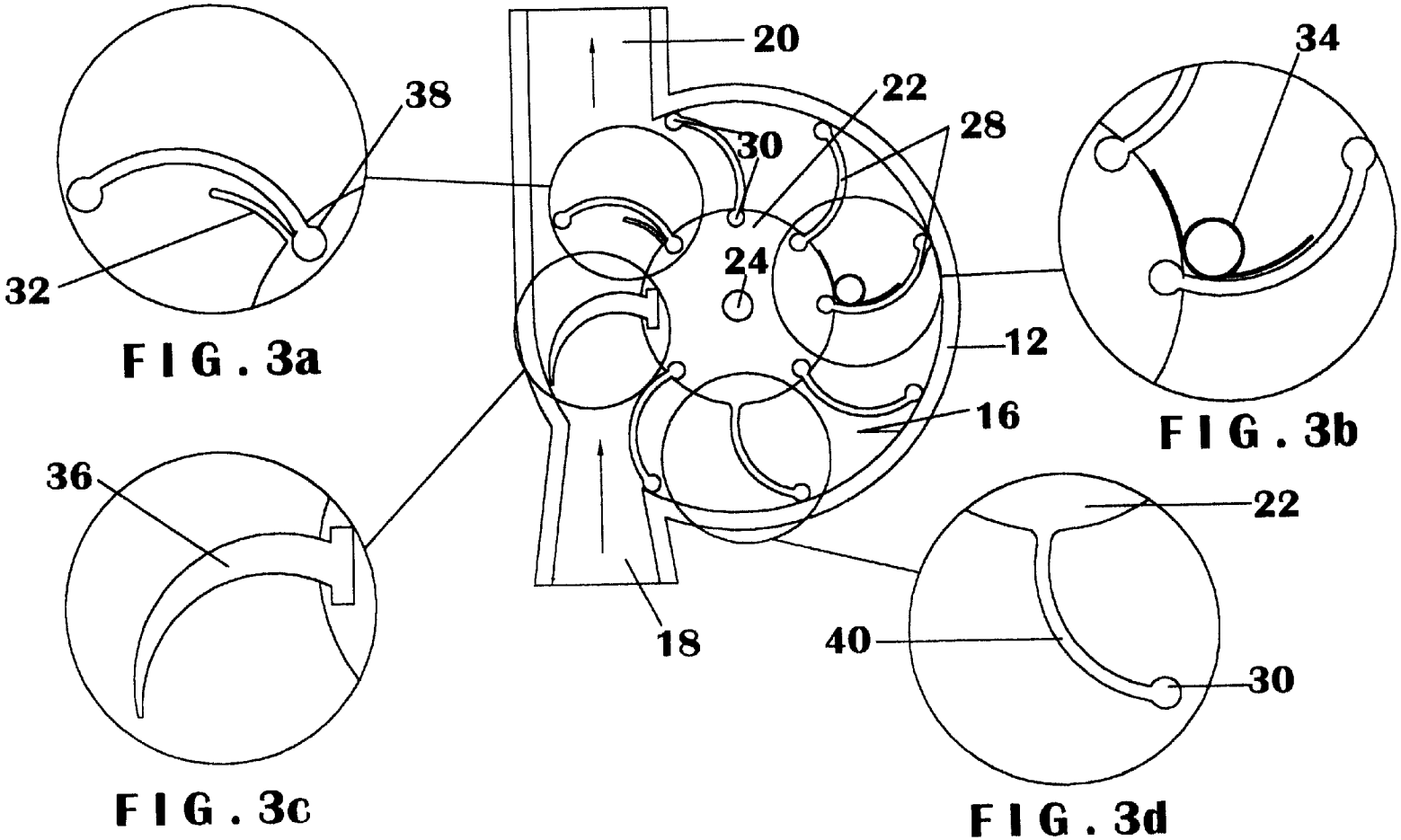
FIG. 3 is a cross-sectional side elevation view of another automatic pool cleaner turbine, such figure being used to illustrate certain alternative vane designs.

FIGS. 1 and 3 show that affixed to the exterior circumference of turbine rotor 22 are a plurality of curved turbine vanes 28, which when in use have their radial positions repetitively actuated by hydraulic forces and by their contact with chamber wall 16. Turbine vanes 28 in FIG. 1 are pivotably connected to turbine rotor 22, but other connection means are possible. Integral formation is one possibility, with the vanes being fabricated from resilient material and having dimensions such that they are able to flex and then return to their original positions (shapes). Whether by pivotable connection or by flexing resilient nature, the intent is that the vanes be oriented in their optimum positions as they drive the turbine rotor about its axis, in order to provide maximum efficiency and power.

Vanes 28 of FIG. 1 pivot about hinges on the turbine rotor. The details of such pivoting arrangement are set forth in greater detail below. However, reference will first be made to alternative relationships of vanes and rotor.

In an embodiment illustrated by FIG. 3*a*, the vanes pivot about integrally formed spring loaded hinges on the circumference of rotor 22. For each such vane, a spring 32 urges the vane into its most extended configuration so that the distal end of the vane is pressed against chamber wall 16. FIG. 3*a* shows that springs 32 may be integrally formed with rotor 22.

In another embodiment, shown in FIG. 3*b*, metal or plastic springs 34 may be used, such springs being connected to the exterior circumference of rotor 22.

FIG. 3*c* shows still another embodiment, this one involving flexible resilient vanes 36 fabricated from elastomers or other resilient materials that bend as they rotate so that it is not necessary that they be pivotably affixed to rotor 22. FIG. 3*c* shows vane 36 connected to the rotor without a pivotable connection.

In yet another embodiment, illustrated in FIG. 3*d*, vane 40 is itself formed integrally with rotor 22. The rotor and vanes are fabricated of a resilient material and configured such that the enlarged distal end 30 of vane 40 is typically urged against chamber wall 16. Integrally-formed vane 40 is substantially uniform in dimension along its length, except for enlarged distal end 30.

In each instance, the vanes are able to adjust to different flow rates to optimize power and efficiency, by virtue of the fact that their distal ends, by one means or another, can retract from chamber wall 30 is necessary, including to accommodate the flow of debris flowing through vacuum chamber 14.

As shown in certain of FIGS. 1 and 3*a*–*d*, the vanes may have cylindrical or other enlargements 30 at both their proximal ends and their distal ends (see FIGS. 1, 3*a* and 3*b*. In these embodiments, the vanes may be inserted at either end into cylindrical cavities 38 in the exterior circumference of turbine rotor 22, in order to simplify assembly. In some cases, the parts can be configured for snap-fit engagement. Depending on the material and relative flexibility of the vane, when the vanes are not spring-loaded, each cavity 38 may widen into an aperture 42 (see FIG. 1) that permits the vanes to swivel in their respective cylindrical cavities. Enlargements at the proximal and distal ends may be shaped other than cylindrically, and the cavities can be correspondingly shaped to allow radial movement within a specified range.

Figure 5:
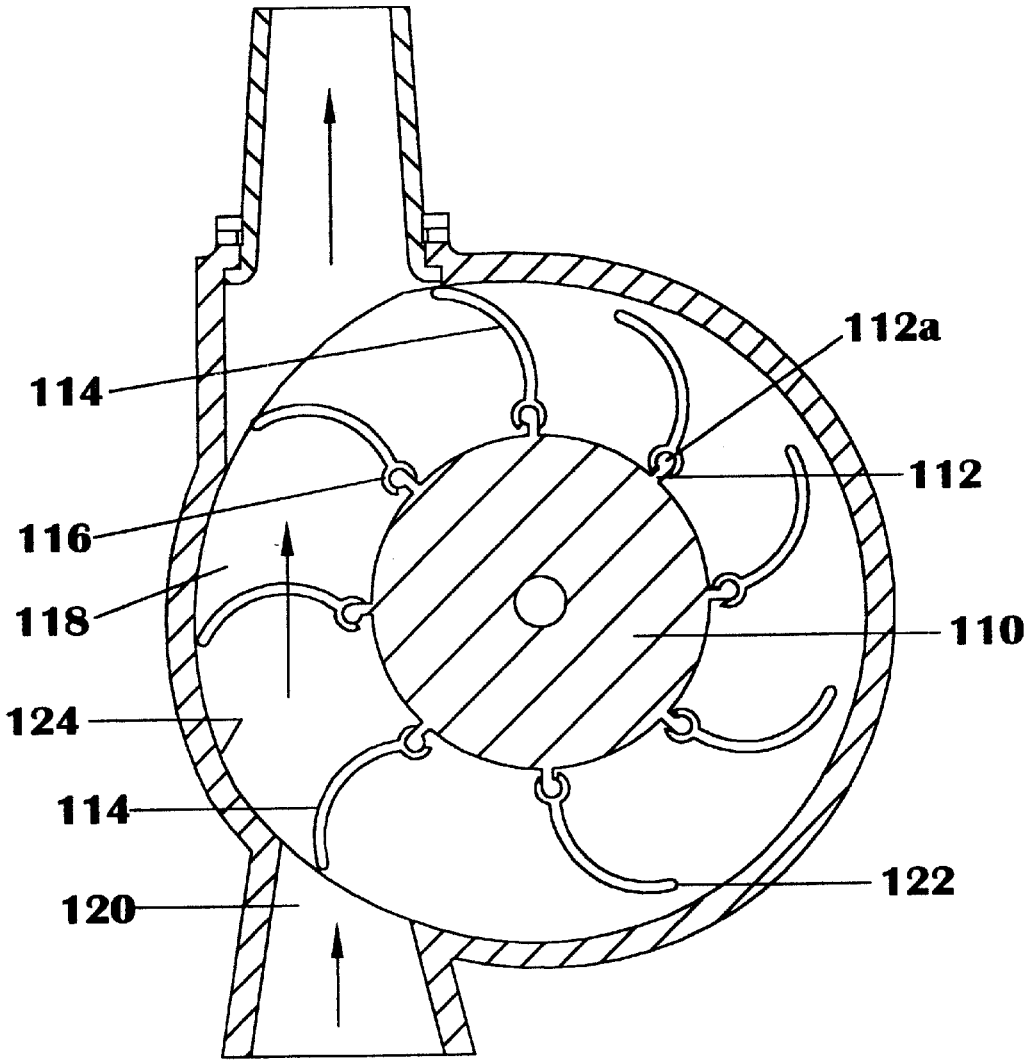
FIG. 5 is a schematic side sectional elevation showing another form of pivotable connection of turbine vanes to a turbine rotor.

While male-vane-into-female-rotor arrangements are preferred, FIG. 5 illustrates a female-vane-over-male-rotor-edge arrangement which provides another form of pivotable vanes-on-rotor engagement. In such embodiment, rotor 110 has male projections 112 projecting radially from the main portion of rotor 110, each projection 112 terminating in a generally cylindrical enlarged edge 112*a*. Vanes 114 have female cavities 116 formed at their proximal edges. Cavities 116 are sized for engagement of enlarged edges 112*a* therein. These parts may be sized for snap-fit engagement such that, once engaged, vanes 114 may freely pivot with respect to rotor 110. Alternatively (or additionally), engagement may be by edgewise insertion.

FIG. 5 also serves to illustrate the flow of water into and through turbine chamber 118, and how the pivoting movement of vanes 114 occurs at different positions about rotor 110 and accomplishes the purposes of this invention. It can be seen that if debris of substantial size enters the inlet port 120, as the lowermost vane 114*a* illustrated in FIG. 5 contacts the debris, vane 114*a* will simply continue to move with rotor 110 without its distal edge 122 moving all the way into contact with the chamber wall 124. The curved shapes of vanes 114 further facilitates this reaction upon encountering substantial debris. Normally, however, distal edges 122 of the vanes will come into contact with chamber wall 124, as illustrated with respect to the other two vanes shown in FIG. 5. This allows full use of the power generated by the remote pump to be harnessed for purposes of causing movement of the automatic pool cleaner.

The power transferred into rotation of the turbine rotors of the turbines in this invention may be transferred to wheels by means of gearing arrangements which are the subject of other commonly-owned patent disclosures. The nature of the turbines of the turbine-driven automatic pool cleaners of this invention allows fairly small amounts of pump power (low pressures) to motivate pool cleaner movement.

Referring again to the vanes, adjustability of vanes may also be accomplished and/or enhanced by the choice of materials of which they are fabricated. Rather than being hinged, the vanes can be made of a soft material that flexes. Other possibilities include vanes fabricated from steel and other suitable, but relatively rigid materials, such as plastic.

Since the vanes pivot or flex, or both pivot and flex, relative to the turbine rotor, close clearances may be maintained between the chamber wall and the most distal end of the vane, thereby minimizing fluid by-pass and power loss.

Figure 4:
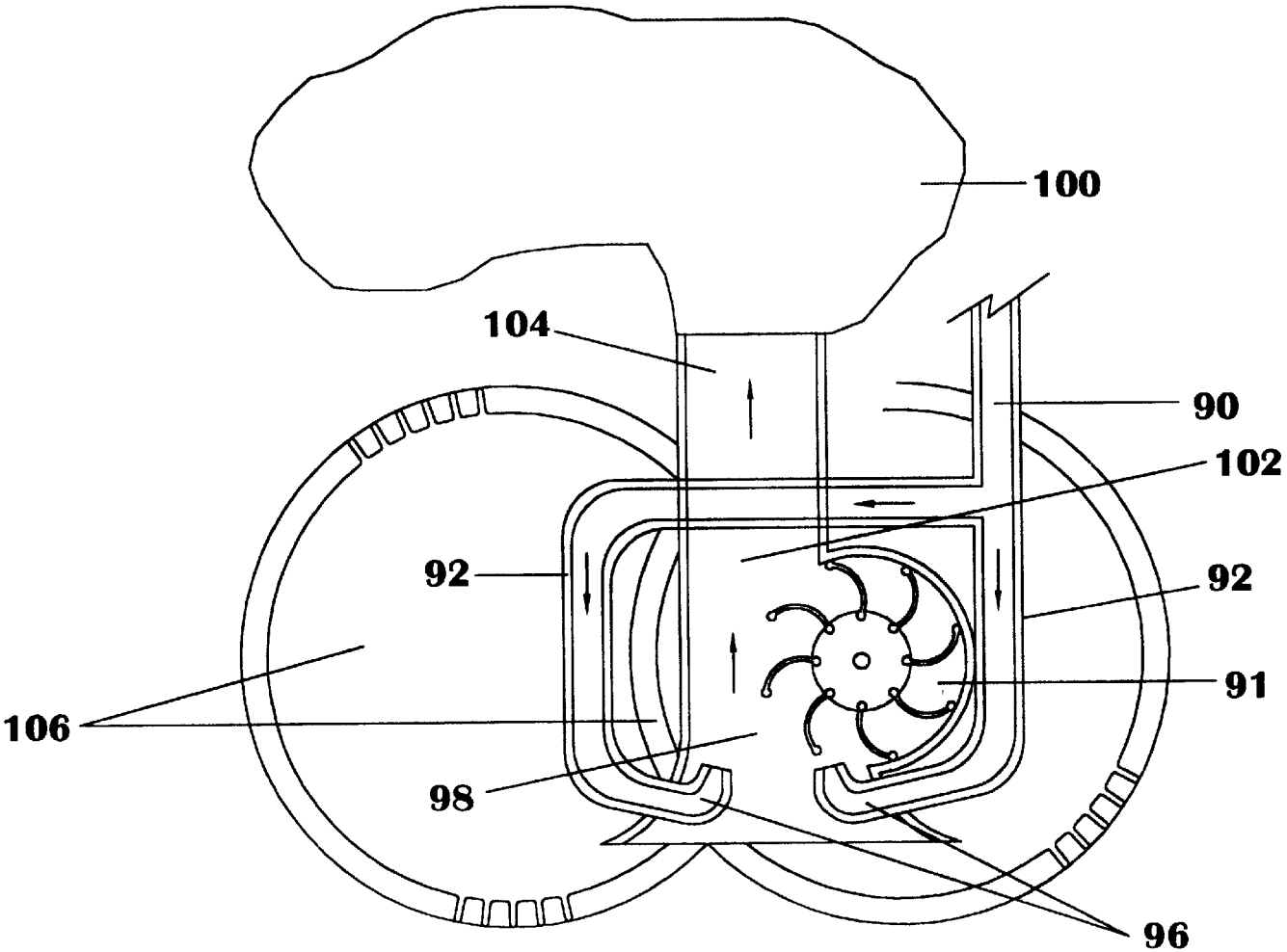
FIG. 4 is a partially-schematic cross-sectional side elevation of another automatic pool cleaner in accordance with this invention—a pressure cleaner, with a different water-flow arrangement than the vacuum cleaning automatic pool cleaners of the other figures.

While the figures discussed thus far relate to automatic pool cleaners which are of the suction type, FIG. 4 illustrates a different form of this automatic pool cleaner invention—the invention as a pressure cleaner, having different water and debris flow arrangement than those of the suction cleaners described above.

In the device of FIG. 4, the water flow (from the remote pump) goes into venturi inlet 90 and eventually into turbine 91. Water pumped into venturi inlet 90 flows through a two-branch venturi flow system 92 until the water flow is accelerated through a pair of venturi jets 96 which inject water into one portion of the turbine chamber 98. The venturi action causes flow of water and debris from below the pool cleaner into turbine chamber 98, and from there it moves upwardly for collection into a debris bag 100, after passage through the outlet port 102 and tube 104. Two of the four wheels of the automatic pool cleaner of FIG. 4 are illustrated, identified by numeral 106.

While the principles of this invention have been described in connection with specific embodiments, it should be understood clearly that these descriptions are made only by way of example and are not intended to limit the scope of the invention.

We claim:

1. In an automatic pool cleaner motivated by flow of water therethrough, established by the pumping action of a remote pump, to move along a pool surface to be cleaned, the improvement comprising:

a turbine housing having a water-flow chamber formed by a chamber wall, the water-flow chamber having inlet and outlet ports, the inlet port facing and being immediately adjacent to the underwater pool surface on which the pool cleaner is traveling to facilitate pickup and intake of debris from such underwater pool surface into the chamber;

a turbine rotor rotatably mounted in the housing and spaced from the chamber wall at all positions thereabout to provide a flow path for water and debris around the rotor; and at least one turbine vane having a proximal edge on and connected to the rotor and a distal edge movable with respect to the rotor between extended positions adjacent to the wall and retracted positions spaced farther from the wall and closer to the rotor, thereby to allow passage of debris pieces of substantial size through the turbine.

2. The device of claim 1 wherein there are a plurality of the vanes spaced around the rotor.

3. The device of claim 2 wherein the vanes are curved along their lengths.

4. The device of claim 2 wherein the chamber wall is substantially round in cross-sections normal to the axis of the rotor.

5. The device of claim 2 wherein the vanes are pivotably mounted with respect to the rotor.

6. The device of claim 5 wherein the vanes pivot with respect to the rotor about axes which are substantially parallel to the axis of the rotor.

7. The device of claim 5 wherein the vanes are of substantially rigid material.

8. The device of claim 5 wherein the vanes have at their distal edges enlargements which are slidingly engageable with the chamber wall.

9. The device of claim 5 wherein the rotor has a circumferential exterior surface beneath which, for each vane, is a corresponding cavity which pivotably holds the proximal edge of the vane.

10. The device of claim 9 wherein the vanes have enlargements at their proximal edges sized for free insertion into, and pivotable engagement in, the cavities.

11. The device of claim 10 wherein the cavities and the proximal-edge enlargements of the vanes are substantially cylindrical.

12. The device of claim 10 wherein the vanes have at their distal edges enlargements which are slidingly engageable with the chamber wall.

13. The device of claim 12 wherein each of the vanes is substantially symmetrical about a center line such that either of the edges thereof parallel to the center line may be pivotably engaged in one of the cavities, thereby to form the proximal edge of the vane.

14. The device of claim 13 wherein the vanes are curved along their lengths.

15. The device of claim 14 wherein the vanes are of substantially rigid material.

16. The device of claim 2 wherein the vanes are fabricated from a resilient polymer.

17. The device of claim 16 wherein the vanes are integrally formed with the rotor and are fabricated to assume a generally extended configuration when not acted on by any force, but which in use may flex to allow debris to pass through the turbine without impeding the radial velocity of the rotor.

18. The device of claim 2 further comprising a plurality of springs secured to the rotor, each spring juxtaposed to one of the vanes to urge the vane into a generally extended position.

19. The device of claim 1 wherein:

the chamber has a first side where the water and debris flow from the inlet port to the outlet port and an opposite side; and the rotor has an axis of rotation which is offset toward the opposite side such that the chamber wall is closer to the rotor at the opposite side than at the first side.

20. The device of claim 1 wherein the inlet and outlet ports are positioned such that a substantially linear flow of water and debris moves tangentially across the rotor.

21. The device of claim 1 wherein the inlet and outlet ports and water flow are such that the automatic pool cleaner is a vacuum cleaner.

22. The device of claim 1 wherein the automatic pool cleaner is a pressure cleaner comprising at least one venturi jet at the inlet port, the venturi jet(s) providing accelerated flow of water from the remote pump, thereby to cause inflow of water and debris at the inlet port from adjacent to the underwater pool surface.

23. In an automatic pool cleaner motivated by flow of water therethrough, established by the pumping action of a remote pump, to move along a pool surface to be cleaned, the improvement comprising:

a turbine housing having a water-flow chamber formed by a chamber wall, the water-flow chamber having inlet and outlet ports, the inlet port being immediately adjacent to the pool surface to facilitate pickup and intake of debris into the chamber;

a turbine rotor rotatably mounted in the housing and spaced substantially equidistantly from the chamber wall at all positions thereabout to provide a flow path for water and debris around the rotor;

a plurality of turbine vanes spaced around the rotor and each having a proximal end connected to the rotor and a distal end each vane being pivotable about its proximal end with respect to the rotor such that its distal end is movable with respect to the rotor between extended positions adjacent to the wall and retracted positions spaced from the wall and closer to the rotor, thereby to allow passage of debris pieces of substantial size through the turbine; and a plurality of springs secured to the rotor, each spring juxtaposed to one of the vanes to pivot the vane into a generally extended position.

* * * * *